US005346244A

United States Patent [19]

Le Masson

[11] Patent Number: 5,346,244

[45] Date of Patent: Sep. 13, 1994

[54] SKI COMPRISING A PROJECTING CENTRAL PLATFORM

[75] Inventor: Jacques Le Masson, Cran-Gevrier, France

[73] Assignee: Salomon SA, France

[21] Appl. No.: 10,181

[22] Filed: Jan. 28, 1993

[30] Foreign Application Priority Data

Jan. 28, 1992 [FR] France ..... 92 01046

[51] Int. Cl.[5] ..... A63C 5/04

[52] U.S. Cl. ..... 280/607; 280/609

[58] Field of Search ..... 280/607, 609, 610, 617, 280/601, 602

[56] References Cited

U.S. PATENT DOCUMENTS

D. 308,239 5/1990 Ollivier ..... D21/224
1,998,702 4/1935 Boline ..... 280/609
2,634,136 4/1953 Tribelhorn ..... 280/610

FOREIGN PATENT DOCUMENTS 2634133 1/1990 France .
440597 9/1947 Italy ..... 280/607
1235307 7/1989 Italy .
52-6239 1/1977 Japan .
PCT/AT90/-00125 12/1990 PCT Int'l Appl. .

*Primary Examiner*—Richard M. Camby
*Assistant Examiner*—Michael Mar
*Attorney, Agent, or Firm*—Pollock, Vande Sande & Priddy

[57] ABSTRACT

Ski having the shape of an elongated beam comprising a lower sliding face, an upper face, and two lateral edges, the upper face comprising, in its central portion, a projecting platform such that the upper face of the ski is constituted by a central upper surface projecting outward from an upper front and rear surface and positioned between these two surfaces. The central platform is extended to the front and/or to the rear by least one connection projection piece whose width is less than the width of the platform, and whose height decreases, at least in its section connecting with the upper front or rear surface.

8 Claims, 9 Drawing Sheets

SKI COMPRISING A PROJECTING CENTRAL PLATFORM

FIELD OF THE INVENTION

The present invention relates to a ski, such as an alpine, cross-country, mono- or snow-surfing ski. It relates, more especially, to an improvement made to this type of ski, and, in particular, to skis comprising a projecting central platform.

BACKGROUND OF THE INVENTION

Various types of skis, of which numerous variants exist, are already known. These skis are constituted by an elongated beam whose front end curves upward so as to form a tip, and whose rear end is also curved, although in less pronounced fashion, so as to form the heel-piece.

Present-day skis normally have a composite structure in which different materials are combined, so that each of them comes optimally into play, given the distribution of the mechanical stresses generated during ski use. Accordingly, the structure generally comprises peripheral protective elements, interior resistance elements which resist flectional and torsional stresses, and a core. These elements are assembled by adhesive bonding or injection, the assembly generally being produced under heat in a mold having more or less the final shape of the ski. Next, the lower surface of the ski is ground down or sanded so as to make it level, and its surface quality must be faultless so as to impart to the ski its sliding and maneuverability properties. This operation is conventionally performed by passing the lower surface of the ski on an abrasive wheel turning at high speed, longitudinal travel of the ski on an abrasive wheel being provided for by a drive wheel supported on the upper surface of the ski. The smallest modification in the longitudinal travel of the ski causes a change in the abrasion operation performed on the sole, which consequently exhibits defects. While the continuity of the travel imparted to a conventional ski whose upper surface has no breaks poses no special problems, the same is not true for skis comprising a projecting platform, for example in the area in which the bindings are mounted. In this case, at the moment when the drive wheel rises suddenly on the platform, there is a break in the continuity of travel, the process of abrading the sole is disrupted, and the sole of the ski then exhibits defects of levelness and surface quality.

SUMMARY OF THE INVENTION

The present invention represents, an attempt to solve these problems and is constituted by a ski shaped like an elongated beam comprising a lower slide surface, an upper face, and two lateral edges, the central portion of the upper face comprising a projecting platform such that the upper face of the ski comprises an upper central surface which projects outward in relation to an upper front and rear surfaces, is positioned between these two surfaces. The central platform is extended toward the front and/or rear by at least one connecting projection piece which is narrower than the platform and whose height decreases, at least in the area in which it connects with the corresponding upper front or rear surface. The projection decreases, for example, over its entire length, from the area of connection with the platform to its end, where it connects with the upper front or rear surface.

According to one embodiment, the platform is extended by two lateral projections, while, in another embodiment, it is extended by a central projection.

According to yet another embodiment, the platform is extended by a connection assembly formed by two partial lateral projections and an additional central projection, while, in a further embodiment, it is constituted by a partial central projection and two complementary lateral projections.

The projection or projections may constitute a substantially rectangular profile whose cross-section gradually decreases and whose upper face forms a connection surface joining the upper surface of the platform to the front or rear upper surface. Alternately, the profile may be substantially triangular, with its cross-section gradually decreasing so as to form a connecting ramp joining the upper surface of the platform to the front or rear upper surface.

BRIEF DESCRIPTION OF THE DRAWINGS

Other features and advantages of the invention will emerge from the following description provided with reference to the attached drawings in which several embodiments are shown by way of example.

DESCRIPTION OF PREFERRED EMBODIMENTS

Figure 1:
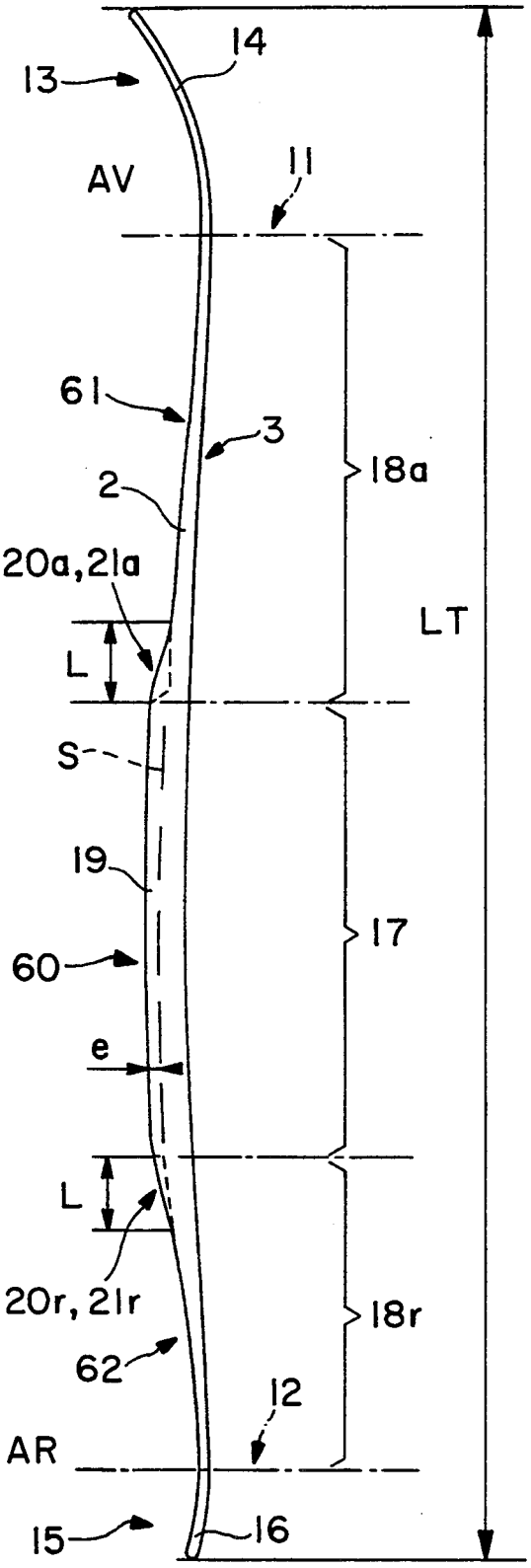
FIG. 1 is a side view of a first embodiment of the invention.

According to conventional practice and as illustrated in the drawings, the ski 1 according to the invention is shaped like an elongated beam 2 comprising a lower sliding surface 3 bounded laterally by two lower edges 4, 5. It comprises an upper surface bounded laterally by two upper edges 7, 8 and two lateral faces 9, 10 connecting the lower edges 4, 5 to these upper edges 7, 8. The body of the ski itself extends between a front contact line 11 and a rear contact line 12, and then is extended toward the front by a front raised part 13 which forms the tip 14, and toward the rear by a shorter, less raised rear part 15 forming the heel-piece 16.

FIG. 1 shows that the body of the ski, between the front and rear contact lines 11 and 12 is, conventionally, slightly cambered in the resting position in the absence of load.

Figure 22:
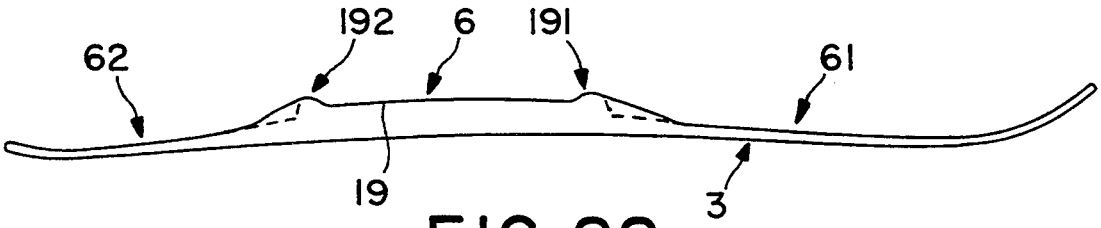
FIGS. 21 and 22 are lateral views of a ski showing two variants.
Figure 21:
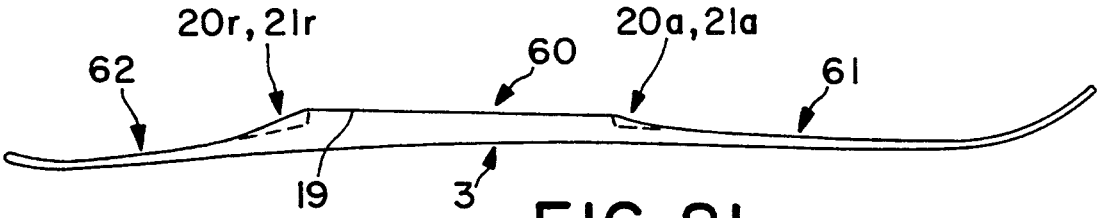

The ski according to the invention comprises a central part 17 extended toward the front by a front section 18*a* extending between the central part 17 and the front contact line 11, and a rear section 18*r* extending between the central part 17 and the rear contact line 12. The central part 17 of the ski, which corresponds to the central zone on which the bindings are mounted, comprises a platform 19 which projects from the remainder of the upper surface of the ski, and, in particular, from the front and rear sections 18*a* and 18*r*. Accordingly, the upper surface of the ski is constituted by an upper central surface 60 projecting from the overall upper surface S of the ski, constituted by the upper front and rear surfaces 61 and 62. This upper central surface 60 is positioned between the upper front surface 61 and the upper rear surface 62. Thus, for example, the platform has a width e in relation to the upper surface S. The thickness e may, for example, be greater than 0.7 millimeter and be substantially constant, as shown in FIGS. 1 to 6, or it may be variable, as illustrated in FIGS. 21 and 22.

According to the embodiment of the invention shown in FIGS. 1 to 9, the central platform 19 is extended toward the front AV and toward the rear AR by two lateral connecting projection pieces, 20*a*, 21*a* toward the front and 20*r*, 21*r* toward the rear, respectively. According to this embodiment, each of the projection pieces is arranged laterally on either side of the general plane of symmetry P of the ski, and each connects the central upper surface 60 to the upper front surface 61 and to the upper rear surface 62. To this end, each of the connecting projection pieces comprises an upper connection surface 22*a*, 23*a*–22*r*, 23*r*. The connecting projection pieces are each narrower than the upper surface 60 of the platform. In the first embodiment, the width of the projecting pieces gradually decreases as they extend from the platform 19 to the ends A. It should also be noted that the height h of each projection piece varies, gradually decreasing as it extends from the platform 19 to the ends. Thus, the height of each of the projection pieces 20*a*, 21*a*–20*r*, 21*r* in the area of the platform is equal to the thickness e of the platform and gradually decreases before becoming nil at the end point A connecting with the upper front and rear surfaces 61 and 62. Accordingly, in this embodiment, the transverse section in a transverse plane T—T of each of the connecting projection pieces is variable as regards both its height h and its width 1*a*. It should be noted that the connecting projection piece could have a constant width 1*s*, while being of a height which gradually decreases, as indicated by the variant in FIG. 10. The shape itself of the projection piece may also vary.

Figure 11:
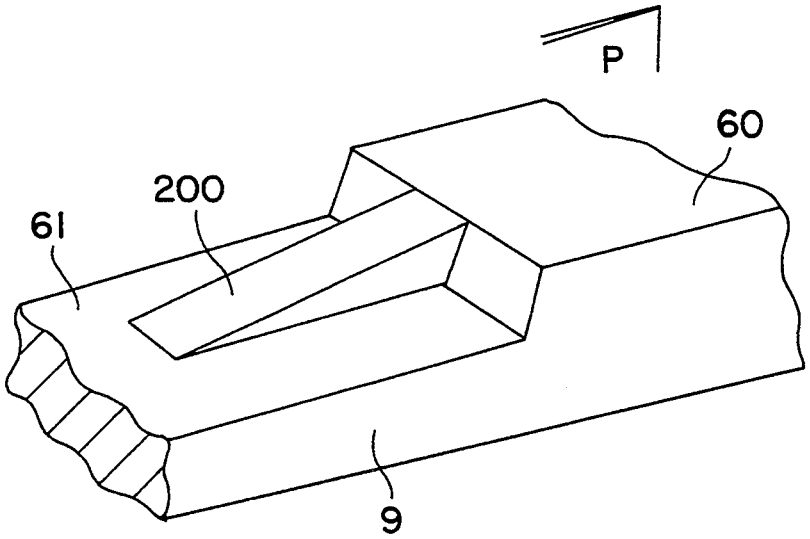
Figure 12:
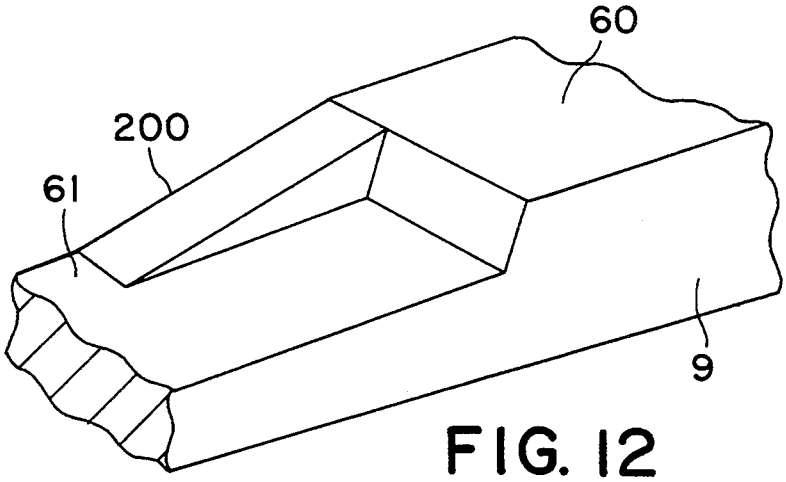

The ski according to the invention may also be so configured that the platform 19 comprises only one central projection piece 200 positioned substantially in the general plane of symmetry P of the ski, as illustrated in FIG. 11. However, this single connecting projection piece could not be centered, but must be offset laterally, as illustrated in FIG. 12.

Figure 13:
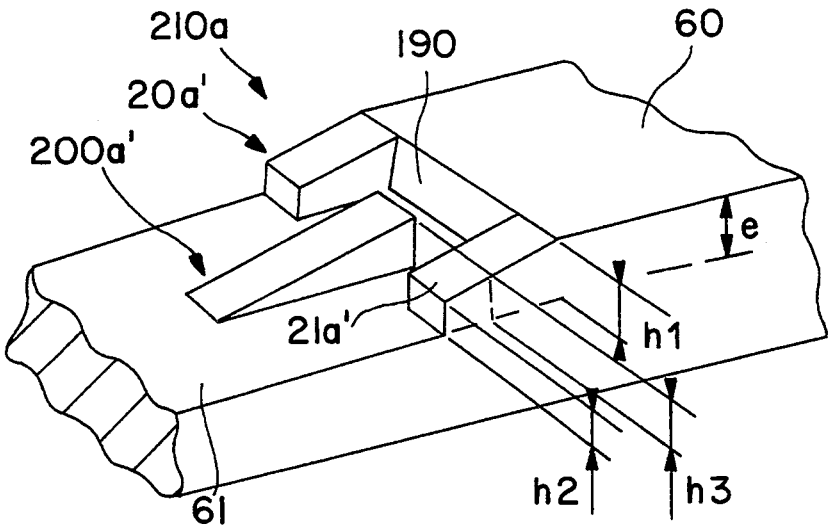
FIGS. 13, 14, and 15 are views similar to FIGS. 7, 8, and 9, respectively, showing a variant.
Figure 14:
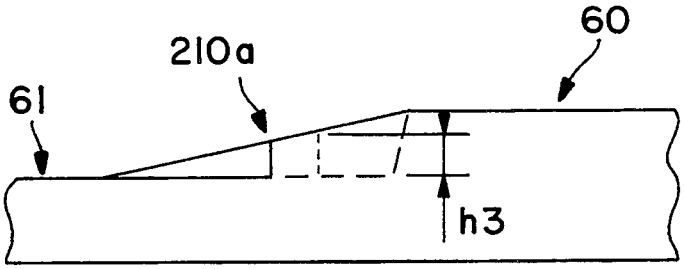
Figure 15:
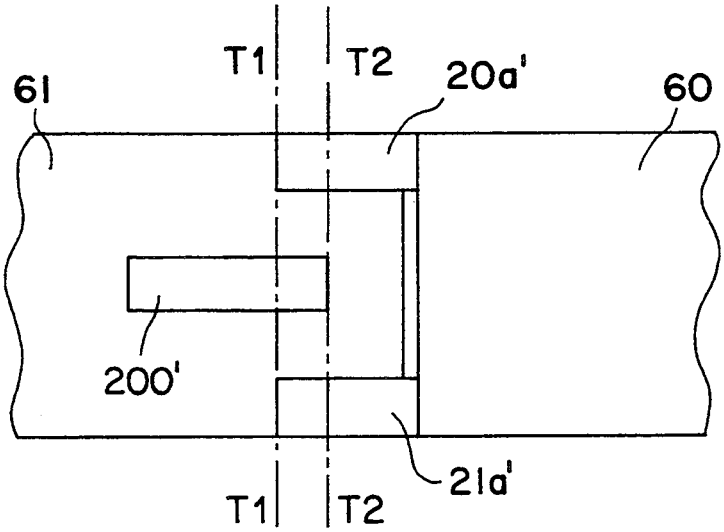

According to the embodiment illustrated in FIGS. 13, 14, and 15, the connection joining the upper surfaces 61, 62 with the upper surface 60 of the platform 19 is formed by a connection assembly 210*a* constituted by two partial lateral projection pieces 20′*a*, 21′*a* and a complementary central projection piece 200′*a*. As shown in the drawings, the height h of each projection piece varies by a height h1 equal to the thickness e of the platform, which then gradually decreases so as to reach, at its ends and in the transverse plane T1—T1 of these ends, a height h2 less than height h1. The complementary central projection piece 200′*a* is a projecting profile positioned between the two partial lateral projection pieces 20′*a*, 21′*a*, so that its end facing the platform lies between the transverse plane T1, T1 and the end 190*a* of the platform 19. The height h3 of this central projection piece at its end facing the platform is equal to the height h3 which the lateral projection pieces have in the transverse plane T2—T2, and then gradually decreases until it becomes nil.

Figure 16:
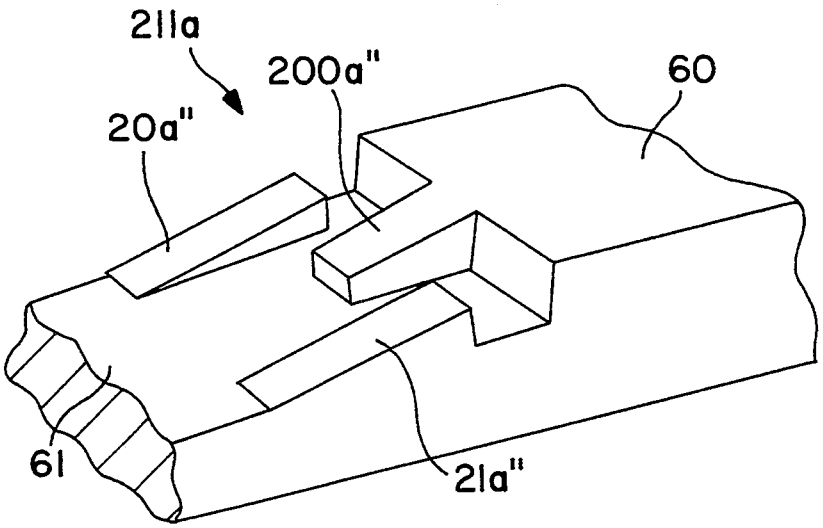
FIGS. 16, 17, and 18 are views similar to FIGS. 7, 8, and 9, respectively, illustrating another variant.
Figure 17:
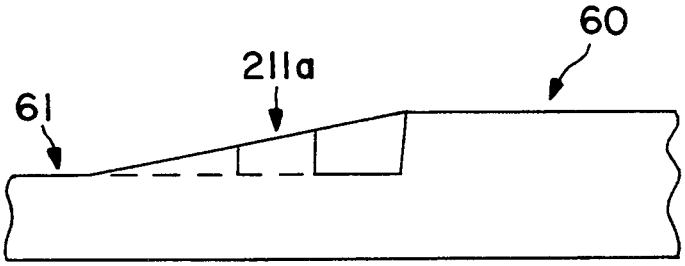
Figure 18:
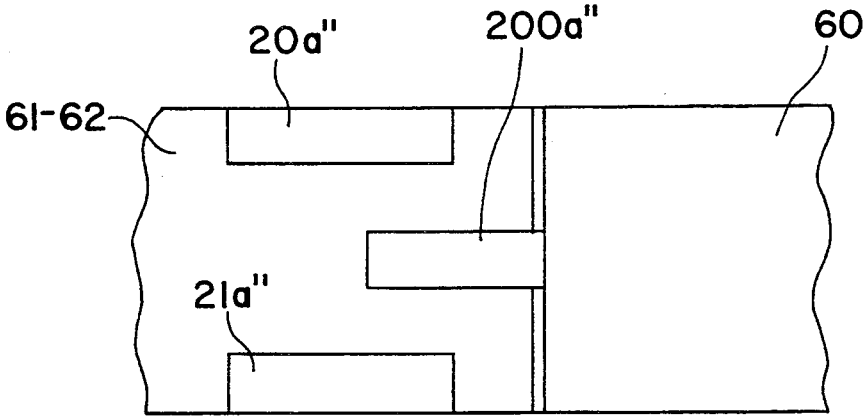
Figure 19:
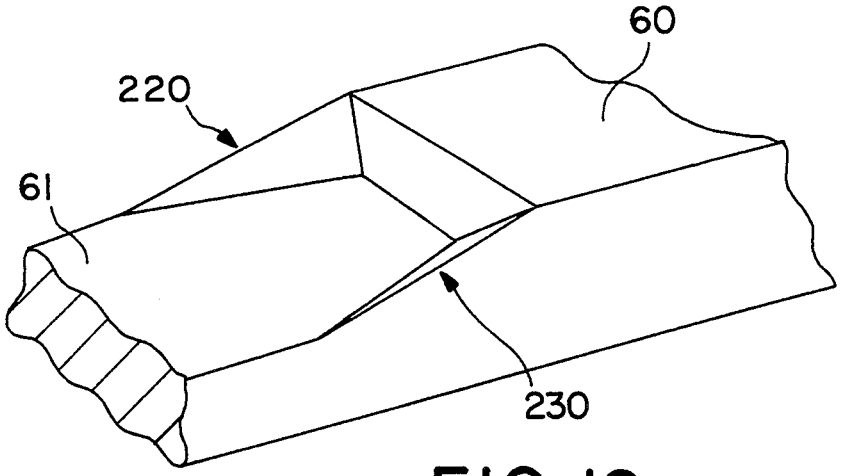
FIGS. 19 and 20 illustrates another embodiment, FIG. 19 being a perspective view similar to FIG. 7, and FIG. 20, a cross-section view similar to FIG. 4.

A reverse construction could also be adopted, in which, for example, as illustrated in FIGS. 16, 17, and 18, the connection assembly 211*a* is constituted by a partial central projection piece 200″*a* forming an extension of the platform and two complementary lateral projection pieces 20″*a*, 21″*a*.

In the embodiments described above, the projection piece or pieces comprise an upper connection surface 22, 23 having the shape of an inclined connection plane joining the upper surface 60 of the platform to the upper front and/or rear surfaces 61, 62.

Figure 10:
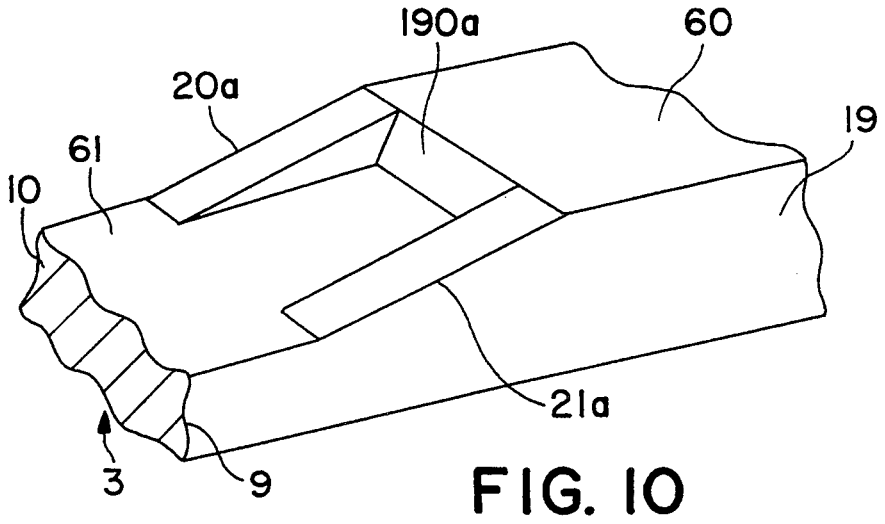
FIGS. 10, 11, and 12 are perspective views similar to FIG. 7, illustrating three other embodiments.
Figure 20:
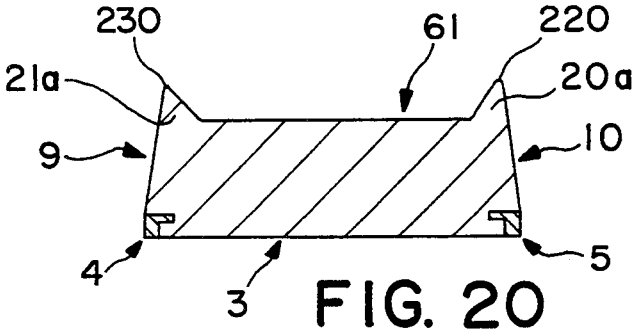

It is evident that the upper faces of the projection pieces could consist solely in a single connection ramp 220, 230. In this case, the connection projection piece or pieces are, for example, constituted by a projecting profile having a substantially rectangular transverse cross-section. This embodiment is illustrated in FIGS. 10 and 20.

The length L of the connecting projection pieces must be sufficient to allow the drive wheel to travel progressively and without jerks, for example, from the upper front surface to the upper surface of the platform, and from the latter to the upper rear surface. This length L could range between 1% and 20% of the total length LT of the ski.

FIGS. 21 and 22 illustrate two variants, according to which the central platform 19 does not have constant thickness. In FIG. 21, the thickness increases progressively toward the rear of the ski; however, the increase in thickness could occur toward the front in a reversed variant (not shown). FIG. 22 shows another variant in which the central platform 19 comprises, at each of its ends, an end projection piece 191, 192.

Figure 23:
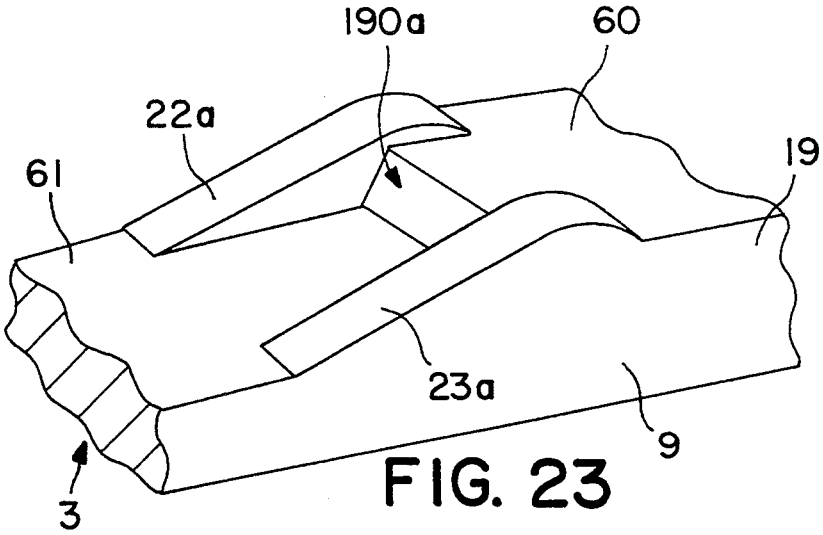
FIGS. 23 and 24 are perspective views showing other variants of the connection zone.
Figure 24:
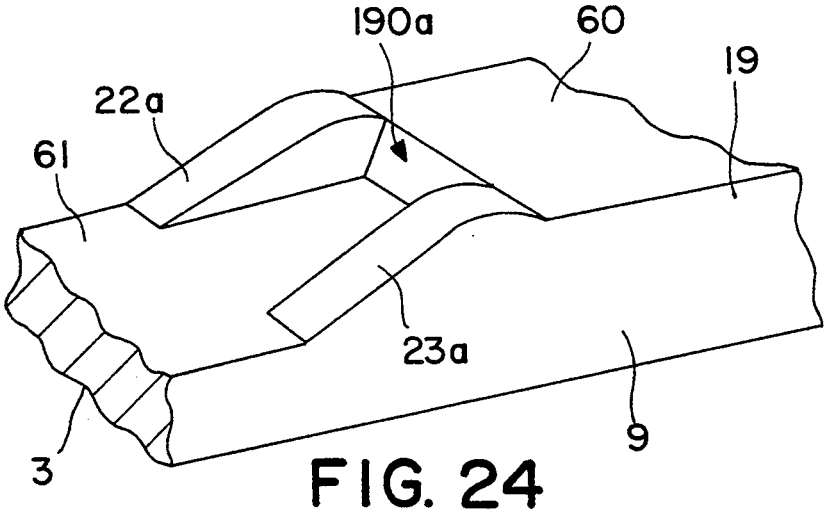
Figure 25:
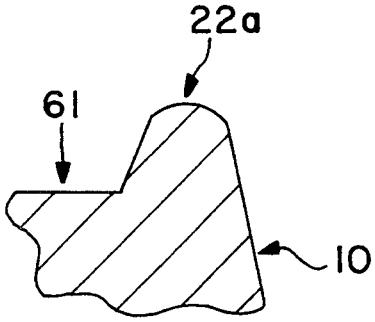
FIG. 25 is a detail view illustrating, in transverse cross-section, a variant of the connecting projection piece.

The connection ramps previously illustrated are formed by planes, but could also be constituted by curved surfaces, as illustrated in FIGS. 23 and 24. It should also be indicated that, in transverse cross-section, the ramp could be curved, as shown schematically in FIG. 25.

Figure 2:
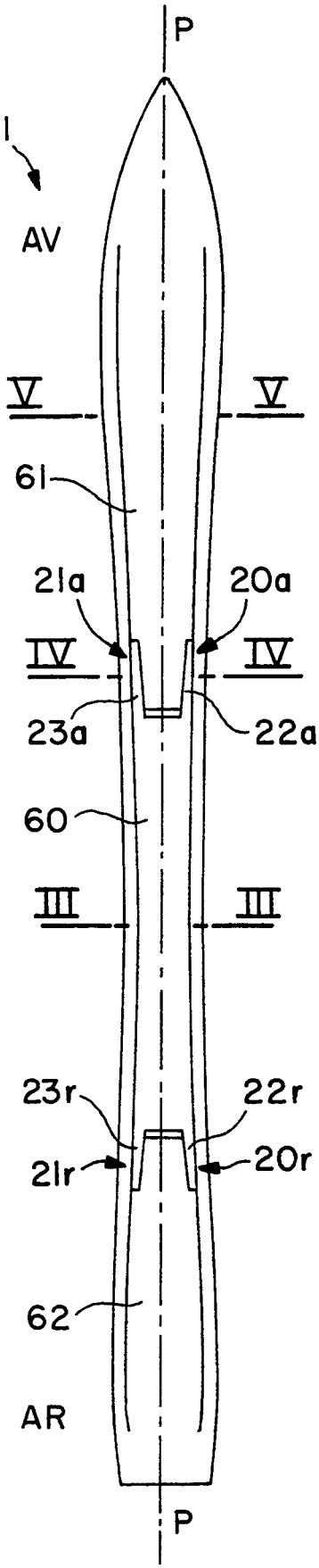
FIG. 2 is a top plane view of the first embodiment.
Figure 3:
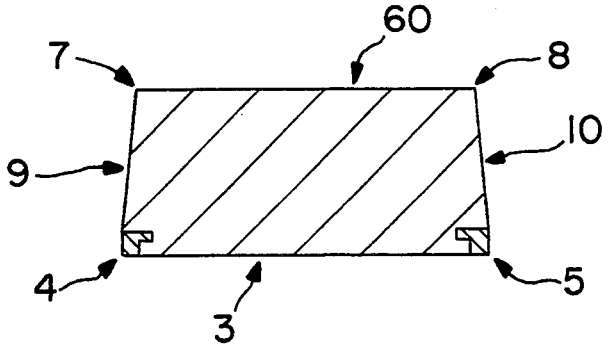
FIG. 3 is a transverse cross-section along line III—III in FIG. 2.
Figure 4:
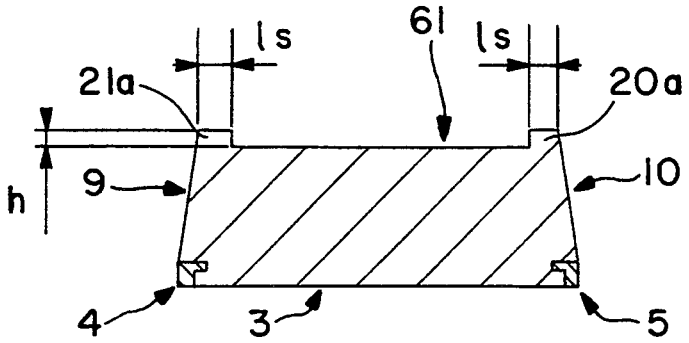
FIG. 4 is a transverse cross-section along line IV—IV in FIG. 2.
Figure 5:
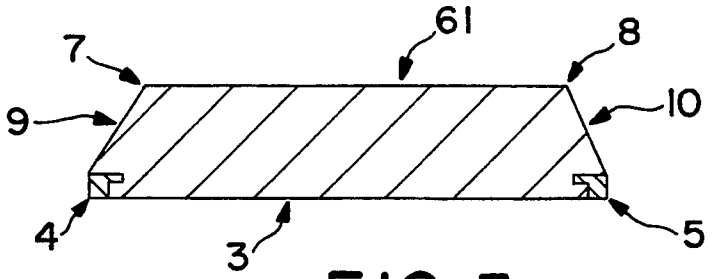
FIG. 5 is a transverse cross-section along line V—V in FIG. 2.
Figure 6:
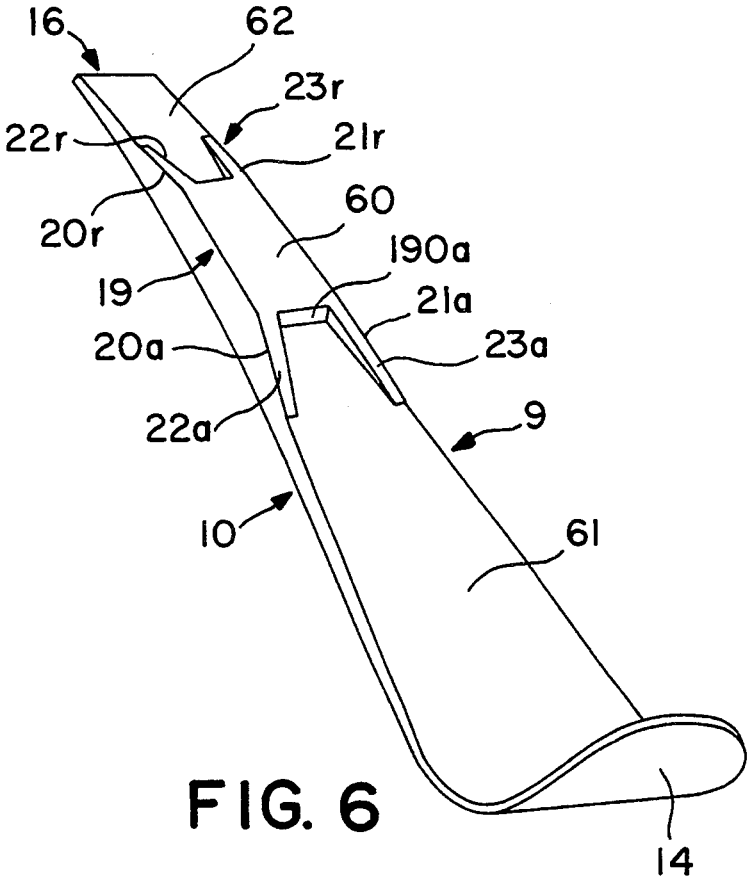
FIG. 6 is a perspective view showing the ski according to the first embodiment.
Figure 7:
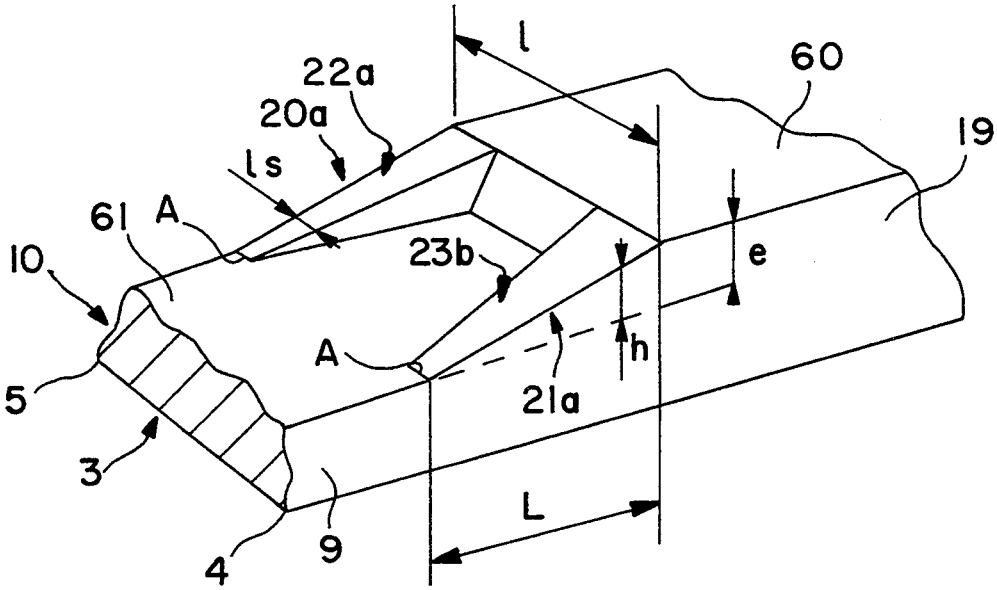
FIG. 7 is a partial perspective view illustrating detail of the invention according one of the embodiments.
Figure 8:
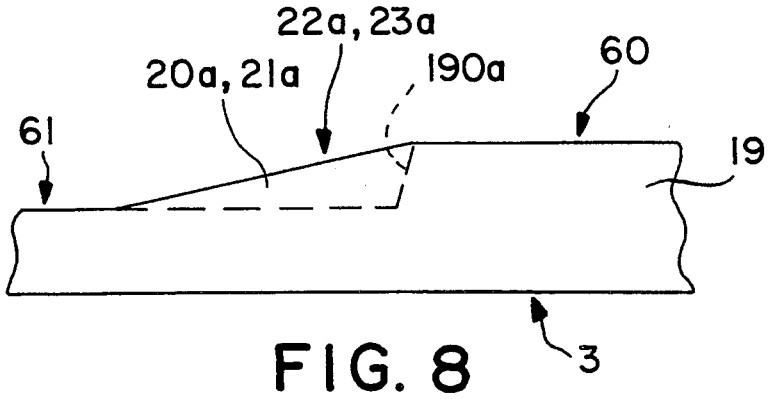
FIGS. 8 and 9 are side and top plan detail views, respectively.
Figure 9:
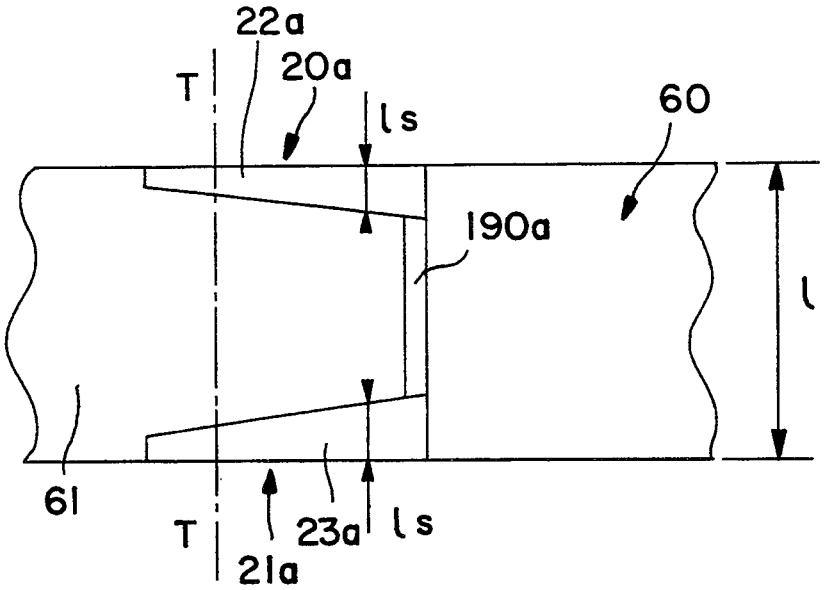

FIGS. 1 and 2 illustrate a ski whose platform is extended toward the front and to the rear using a connecting projection piece according to the invention. However, the platform could obviously be extended only to the front or to the rear.

FIGS. 7 to 20, 23, and 24 illustrate different embodiments of a platform connection zone. The references to the various elements correspond to a front connection zone. The various embodiments of a rear connection zone would be illustrated using the same figures, in which case the references 20*a*, 21*a*, 22*a*, 23*a*, 61, 190*a* would be 20*r*, 21*r*, 22*r*, 23*r*, 62, 190*r*, respectively, and

20″*a*, 21″*a*, 211*a*, 200″*a* would be 20″*r*, 21″*r*, 211*r*, 200″*r*.

What is claimed is:

1. A ski having the shape of an elongated beam comprising a lower slide face, an upper face, and two lateral edges, said upper face having a central portion comprising a platform projecting upward so that the upper face of said ski is consituted by an upper central surface projecting upward from a front upper surface and a rear upper surface and positioned between said front and rear upper surfaces, said central platform having a front edge and a rear edge and at least two connection projection portions laterally spaced from each other and extending from each of said front and rear edges toward the front and rear of the ski, each of said portions being narrower than said platform and having a height which decreases from one end at the upper central surface to an opposite end which merges into a respective front and rear upper surface, wherein each of said connection projection portions has a longitudinal length which is substantially less than a longitudinal length of said upper central surface between said front and rear edges.

2. Ski according to claim 1, wherein the height of said projection portions decreases over their entire length extending from the zone of connection with said platform to said upper front and rear surface to the ends of said projection portions.

3. Ski according to claim 1, wherein said projection portions have a substantially rectangular profile whose cross-section gradually decreases and whose upper face constitutes a connection surface connecting said upper surface of said platform to said upper front and rear surface.

4. Ski according to claim 3, wherein said connection surface is rectilinear.

5. Ski according to claim 3, wherein said projection portions have a cross-section of variable width.

6. Ski according to claim 5, wherein said width gradually decreases as it extends from said platform to ends of said projection portions.

7. Ski according to claim 1, wherein said platform has a thickness greater than 0.7 millimeter.

8. Ski according to claim 7, wherein said connecting projection portions have a length between 1% and 20% of a total length of said ski.

* * * * *